US008636157B2

(12) United States Patent
Glickman et al.

(10) Patent No.: US 8,636,157 B2
(45) Date of Patent: Jan. 28, 2014

(54) SCREW-DRIVEN VERTICALLY-ELEVATING CAB

(75) Inventors: Myron Glickman, Arlington Heights, IL (US); Eric Brian Van Gorp, Schererville, IN (US); John J. Lanigan, Jr., New Lenox, IL (US); James Thomas Russo, Chicago Heights, IL (US); Daniel Brian Zakula, Sr., Mokena, IL (US)

(73) Assignee: Mi-Jack Products, Inc., Hazel Crest, IL (US)

( * ) Notice: Subject to any disclaimer, the term of this patent is extended or adjusted under 35 U.S.C. 154(b) by 424 days.

(21) Appl. No.: 12/973,762

(22) Filed: Dec. 20, 2010

(65) Prior Publication Data

US 2012/0152879 A1 Jun. 21, 2012

(51) Int. Cl.
*B66C 5/02* (2006.01)

(52) U.S. Cl.
USPC ..... 212/324; 414/460; 254/92; 254/98

(58) Field of Classification Search
USPC ..... 212/291, 324, 325, 343–345; 254/92, 254/98; 414/460
See application file for complete search history.

(56) References Cited

U.S. PATENT DOCUMENTS

| | | | | | |
|---|---|---|---|---|---|
| 1,727,436 | A | | 9/1929 | Kreutzkamp | |
| 1,963,022 | A | * | 6/1934 | Kettelson | 187/214 |
| 2,037,531 | A | * | 4/1936 | Moore | 254/98 |
| 2,065,397 | A | * | 12/1936 | Ronning | 172/791 |
| 2,792,913 | A | * | 5/1957 | Capgras | 254/92 |
| 2,909,298 | A | * | 10/1959 | Baudhuin | 414/461 |
| 3,116,910 | A | * | 1/1964 | Moore et al. | 254/126 |
| 3,520,426 | A | * | 7/1970 | Hostetler | 414/545 |
| 4,546,852 | A | * | 10/1985 | Martin et al. | 182/12 |
| 4,795,172 | A | | 1/1989 | Brande | |
| 5,036,951 | A | * | 8/1991 | Frangos | 187/214 |
| 5,172,442 | A | * | 12/1992 | Bartley et al. | 5/611 |
| 5,339,704 | A | | 8/1994 | Lindberg | |
| 5,397,207 | A | * | 3/1995 | Arellano et al. | 414/11 |
| 5,518,220 | A | * | 5/1996 | Bertrand et al. | 254/7 B |
| 5,529,452 | A | | 6/1996 | Boyles et al. | |
| 5,702,222 | A | | 12/1997 | Rosen | |
| 5,810,183 | A | | 9/1998 | Feider et al. | |
| 5,816,368 | A | | 10/1998 | Barrett et al. | |
| 5,816,764 | A | * | 10/1998 | Bohata | 414/477 |

(Continued)

OTHER PUBLICATIONS

International Search Report and Written Opinion of the International Searching Authority for PCT/US2011/053221, dated Feb. 22, 2012, (12 pages).

*Primary Examiner* — Emmanuel M Marcelo
(74) *Attorney, Agent, or Firm* — McCracken & Frank LLC

(57) ABSTRACT

A lifting system for a vertically-elevating cab, the lifting system includes a frame assembly having a first and a second support column, first and a second lift screws which are attached to the, respective, first and second support columns, a cab-lifting beam that has a first and a second end attached to the, respective, first and second lift screws. A vertically-elevating cab is mounted on the cab-lifting beam in such a manner that a center of gravity of the cab is not aligned with a center of the cab-lifting beam. A plurality of rollers are located on each end of the lifting beam. Each one of the plurality of rollers is in contact with a guide bar on each of the respective first and second support columns, and a first and a second power system is connected to the, respective, first and second lift screw.

14 Claims, 9 Drawing Sheets

(56) References Cited

U.S. PATENT DOCUMENTS

| | | | | |
|---|---|---|---|---|
| 7,070,060 | B1 | 7/2006 | Feider et al. | |
| 7,383,922 | B1 * | 6/2008 | Richey et al. | 187/267 |
| 8,286,754 | B2 * | 10/2012 | Cohn | 187/267 |
| 2004/0067124 | A1 | 4/2004 | Lee | |
| 2010/0111661 | A1 | 5/2010 | Svanda | |
| 2012/0193590 | A1 * | 8/2012 | Horwath et al. | 254/92 |

* cited by examiner

SCREW-DRIVEN VERTICALLY-ELEVATING CAB

FIELD OF THE INVENTION

This invention pertains to gantry cranes and, more particularly, to elevating cabs employed on gantry cranes.

BACKGROUND OF THE INVENTION

It is common practice for cranes to be used to lift heavy objects in order to reposition them from one place to another. Known cranes come in various sizes and shapes and are designed to ensure the safe handling of a load while it is in transit. While it is always important that a crane operator be able to see the object he is lifting, depending on what is being lifted, and the purpose for the lift, a crane operator may need the ability to reposition himself vertically with respect to the object being lifted in order to ensure that the object is placed gently and safely in the desired location.

For example, a crane operator who is lifting debris left over from a demolition or construction project may safely operate a crane from a ground or near ground position as he most likely only needs to have enough visibility to see that the object being lifted does not impact anything as it is moved from one position to the next. This is especially true if the operator is handling debris as there is less concern about the integrity of the object being lifted as it is dropped in its new position. If however, the crane operator is operating an intermodal crane or other material handling machine that is lifting a container filled with finished goods that are to be shipped to a store or final customer, the operator may desire the ability to adjust his position to various eye levels with respect to the load so as to be able to see both above and below the load to, for example, look down over the side rail of a ship or on top of a rail car so as to be able to gently reposition the container in an exact spot.

In order to allow a crane operator to be able to adjust his position vertically with respect to a load, vertically-elevating operator cabs have been employed on cranes such as gantry cranes and the like. Traditionally, these vertically-elevating cabs have relied on lift systems comprised of wire ropes or chains to raise or lower the cab from one position to another. Various problems are associated with such lift systems including the fact that the ropes or chains may fray or break. Furthermore, such lift systems are rather complex and may not always prevent a repositioned cab from sliding back down toward the ground once it has been raised to a desired level. For these and various other reasons, a lifting system for a vertically-elevating cab used with a crane would be an important improvement in the art.

BRIEF SUMMARY OF THE INVENTION

Disclosed is a lifting system for a vertically-elevating cab used in conjunction with intermodal cranes or other material handling machines. The lifting system is comprised of a frame assembly having a first and a second support column. First and second lift screws are attached to the, respective, first and second support columns. A cab-lifting beam has a first and a second end attached to the, respective, first and second lift screws. A vertically-elevating cab is mounted on the cab-lifting beam in such a manner that a center of gravity of the cab is not aligned with a center of the cab-lifting beam. A plurality of rollers are located on each end of the lifting beam. Each one of the plurality of rollers is in contact with a guide bar on each of the respective first and second support columns. A first and a second power system is connected to the, respective, first and second lift screw.

DETAILED DESCRIPTION OF THE INVENTION

The following discussion illustrates the disclosed lifting system 10 in conjunction with a rubber tired intermodal gantry crane used for handling container and trailers but, of course, should not be construed as in any way limiting the scope of the invention when applied to other devices where elevation of an operator's cab may be required.

Figure 1:
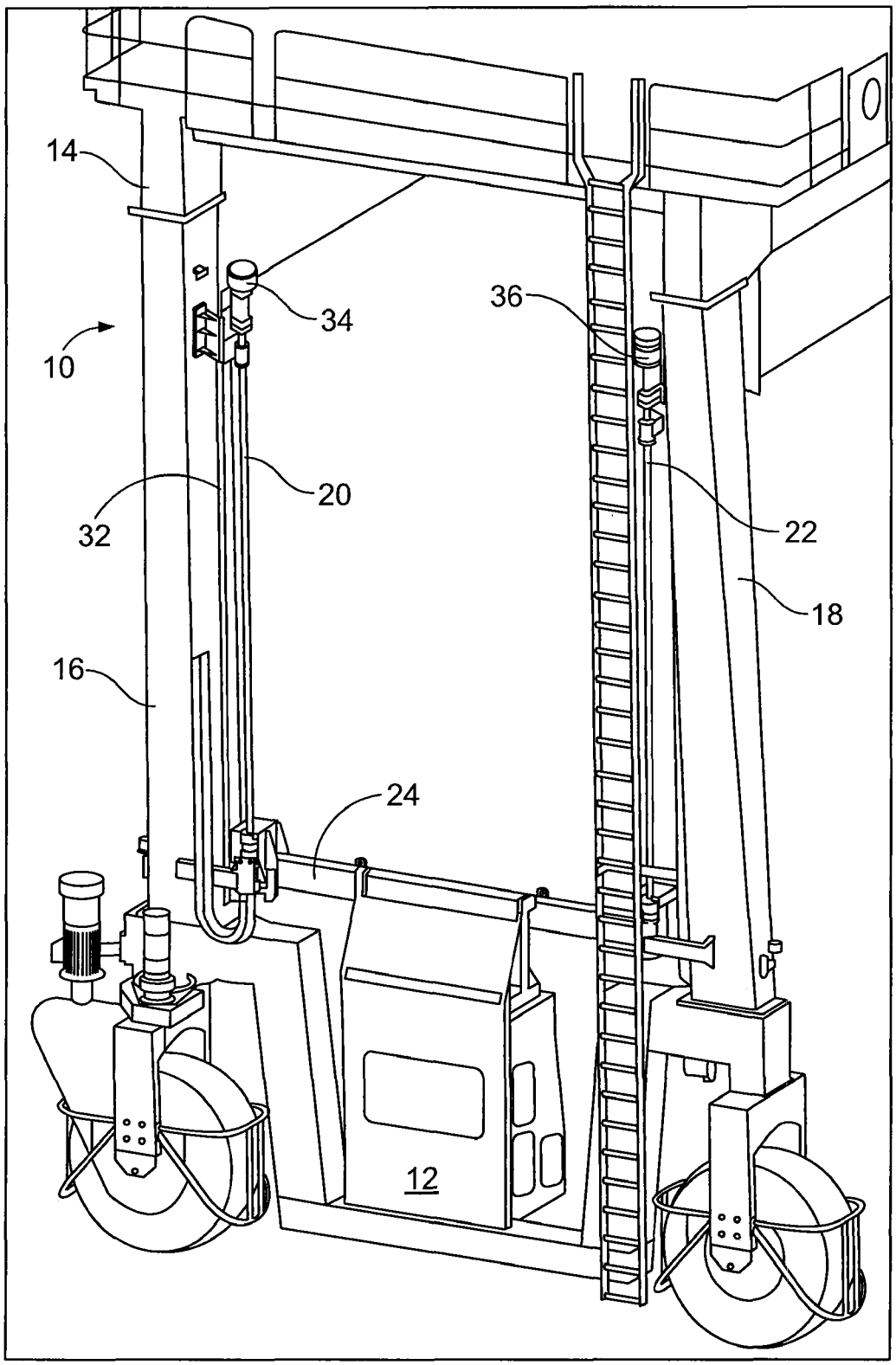
FIG. 1 is a perspective view of the claimed lift system on a rubber tired gantry crane.
Figure 2:
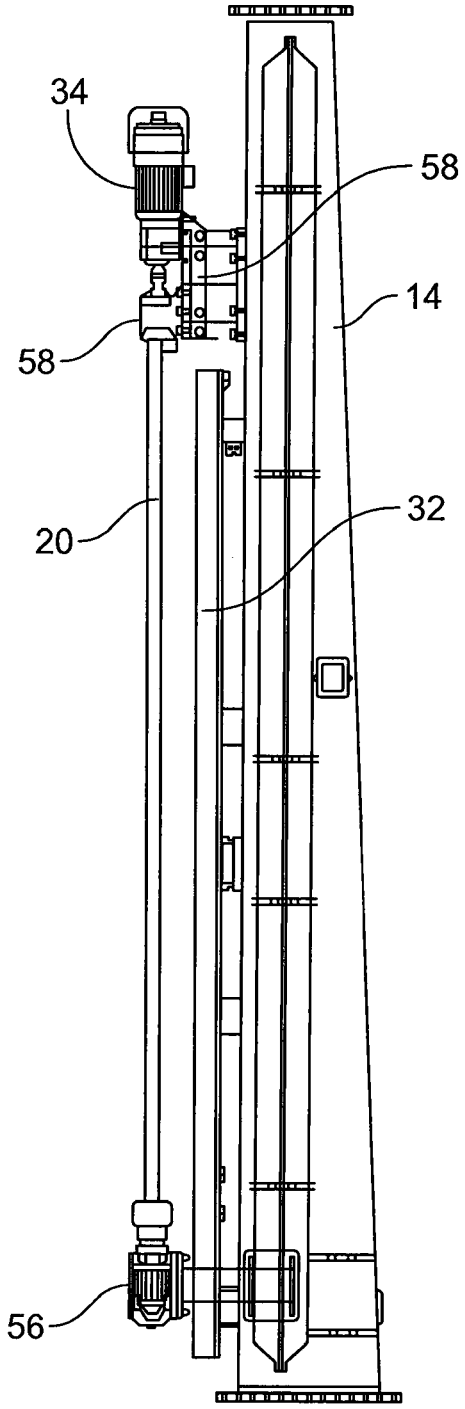
FIG. 2 is a front view of a column assembly used with the claimed lift system showing a lift screw, power system, guide bar, and support column.
Figure 2A:
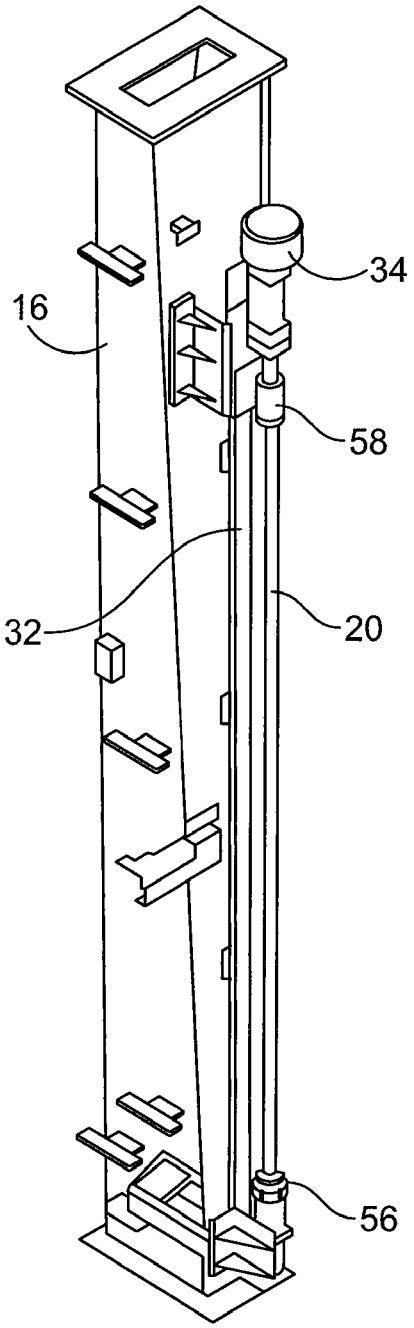
FIG. 2A is a perspective view of the column assembly used with the claimed lift system.
Figure 2B:
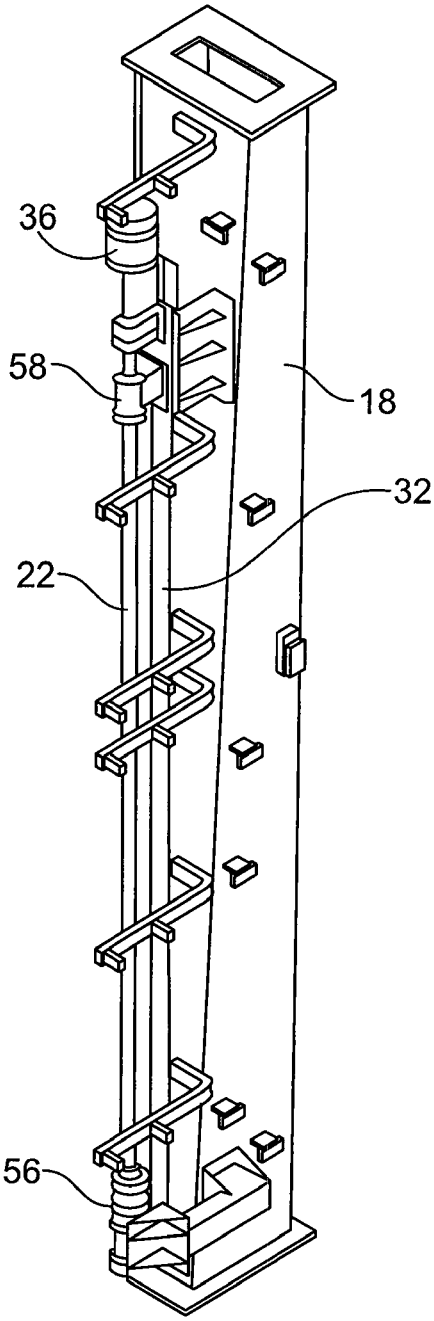
FIG. 2B is a second perspective view of the column assembly used with the claimed lift system.
Figure 4:
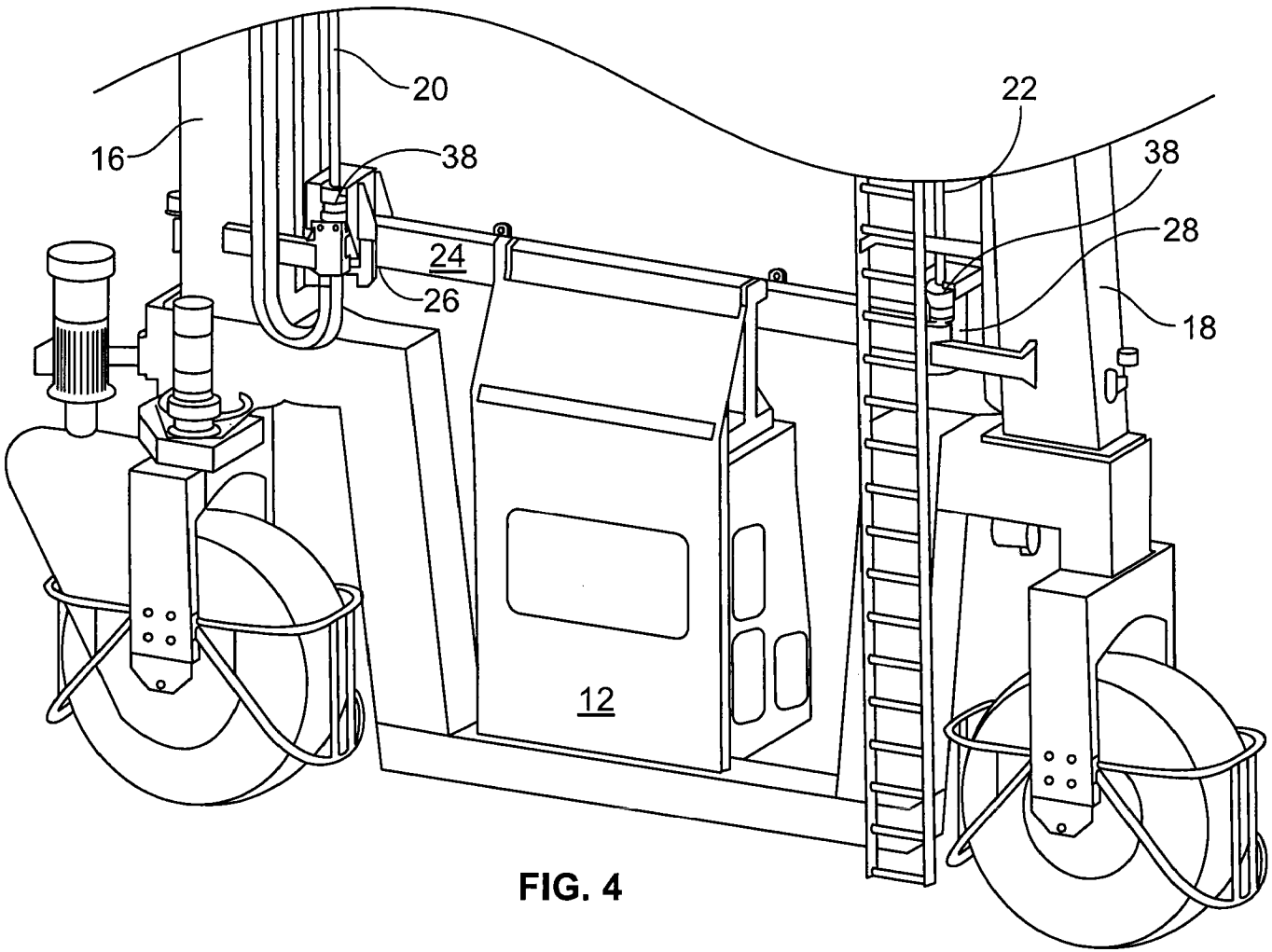
FIG. 4 is a perspective view of a vertically elevating cab mounted on a cab lifting bar used in the claimed lift system.
Figures 5A, 6:
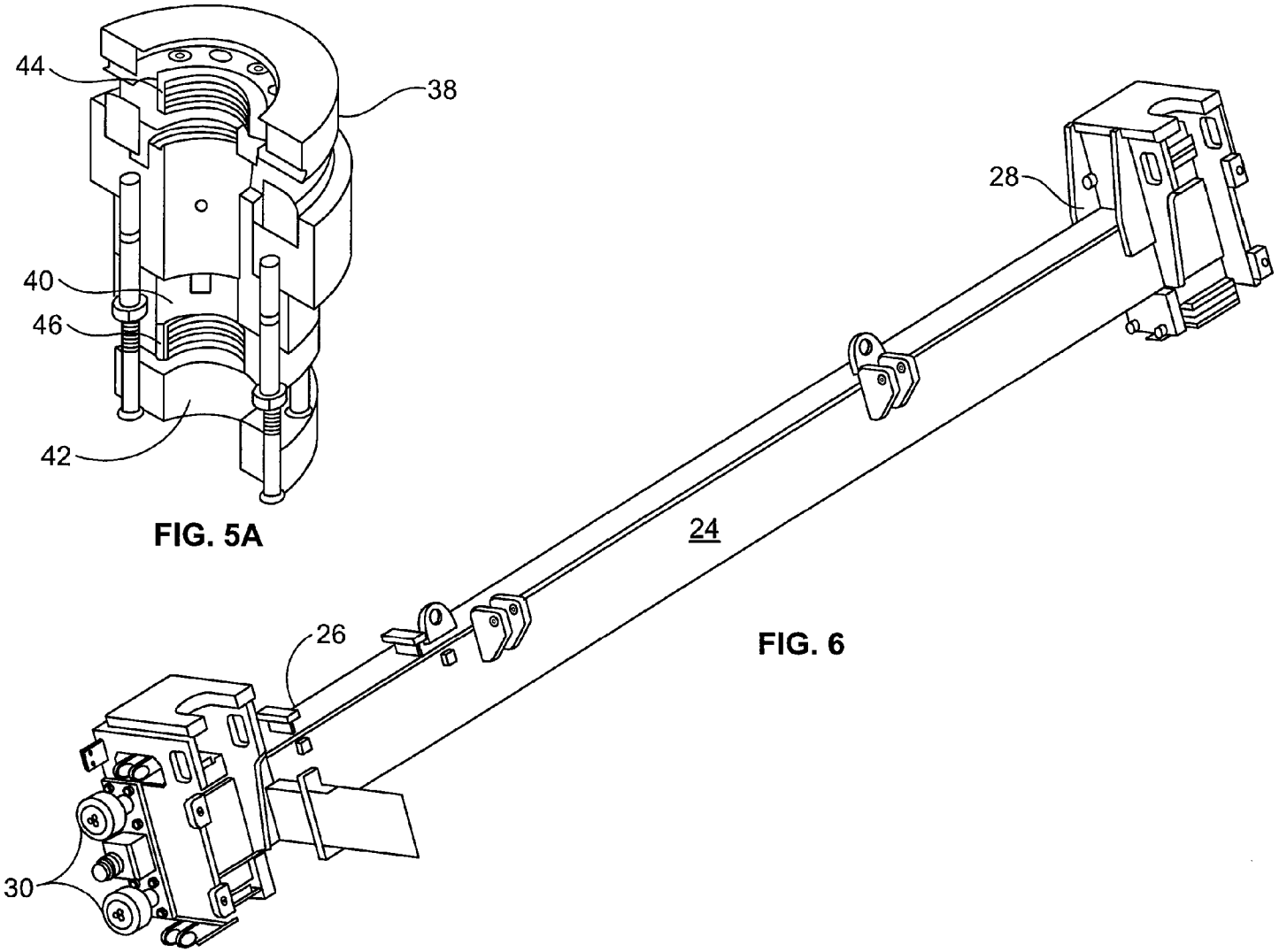
FIG. 5A is a perspective view of section of the nut assembly used in an embodiment of the claimed lift system.
FIG. 6 is a perspective view of the cab lifting beam.
Figure 7:
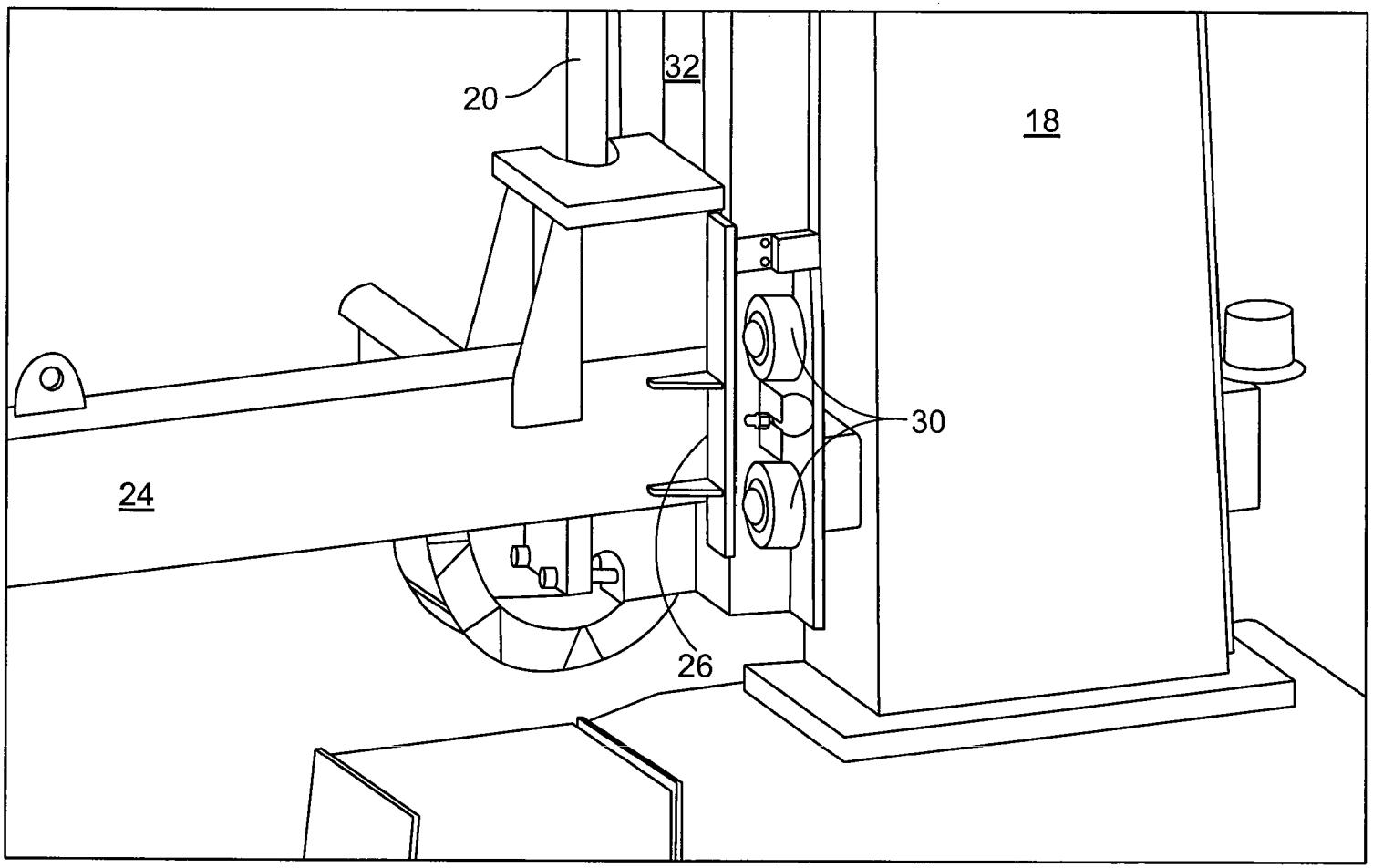
FIG. 7 is a perspective view of one end of a cab lifting bar showing rollers that are used in the claimed lift system.

Disclosed is a lifting system 10 for a vertically elevating cab 12 used in conjunction with intermodal cranes or other material handling machines. As shown in FIGS. 1 and 4, the lifting system 10 is comprised of a frame assembly 14 having a first 16 and a second 18 support column. These support columns 16, 18 may themselves be part of the frame 14 of the crane or material handling machine. A first 20 and a second 22 lift screw are attached to the, respective, first and second support columns 16, 18. A cab-lifting beam 24, as shown in FIG. 6, that has a first 26 and a second 28 end is attached to the, respective, first and second lift screws 20, 22. As shown in FIGS. 1 and 4, the vertically elevating cab 12 is mounted on the cab-lifting beam 24 in such a manner that a center of gravity of the cab 12 is not aligned with a center of the cab-lifting beam 24. As shown in FIGS. 6 and 7, a plurality of rollers 30 are located on each side of end of the lifting beam 26, 28. Each one of the plurality of rollers 30 is in contact with a guide bar, as partially shown for clarity in FIG. 6, on each of the respective first and second support columns 16, 18. A first 34 and a second 36 power system is connected to the, respective, first and second lift screw 20, 22, as shown in FIGS. 1, 2, 2A and 2B.

In an embodiment, the lifting screws 20, 22 may be Acme screws, however, any suitable-like screws may be used without departing from the spirit and scope of the invention. In a more specific embodiment, the screw pitch is such that the screws 20, 22 are non-backdriving. A first 56 and a second 58 bearing support may also be attached at a respective first and second end of each of the lift screw 20, 22.

Figure 3:
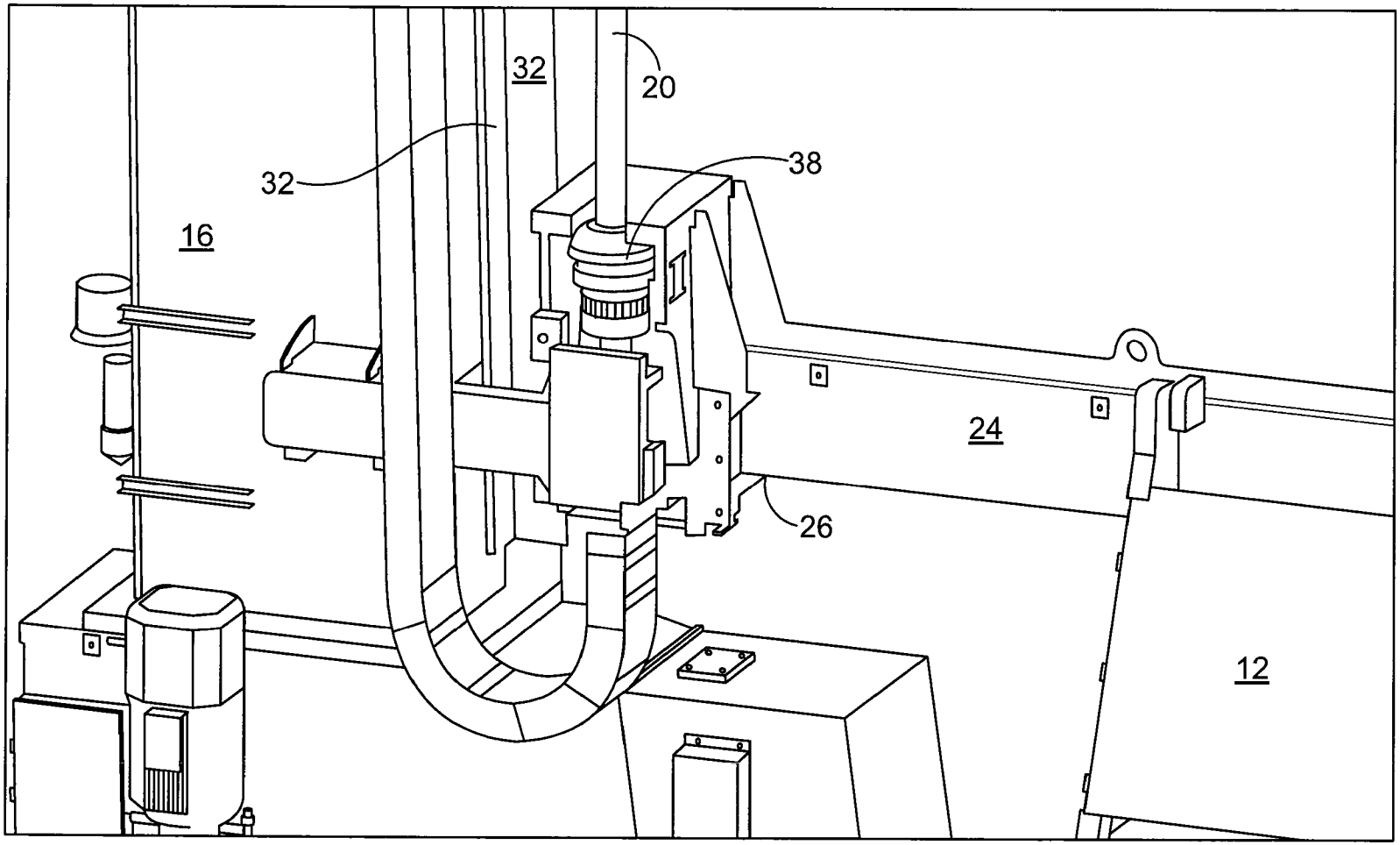
FIG. 3 is a perspective view showing a cut-away of the nut assembly at the end of the cab lifting bar in contact with the lift screw.
Figure 5:
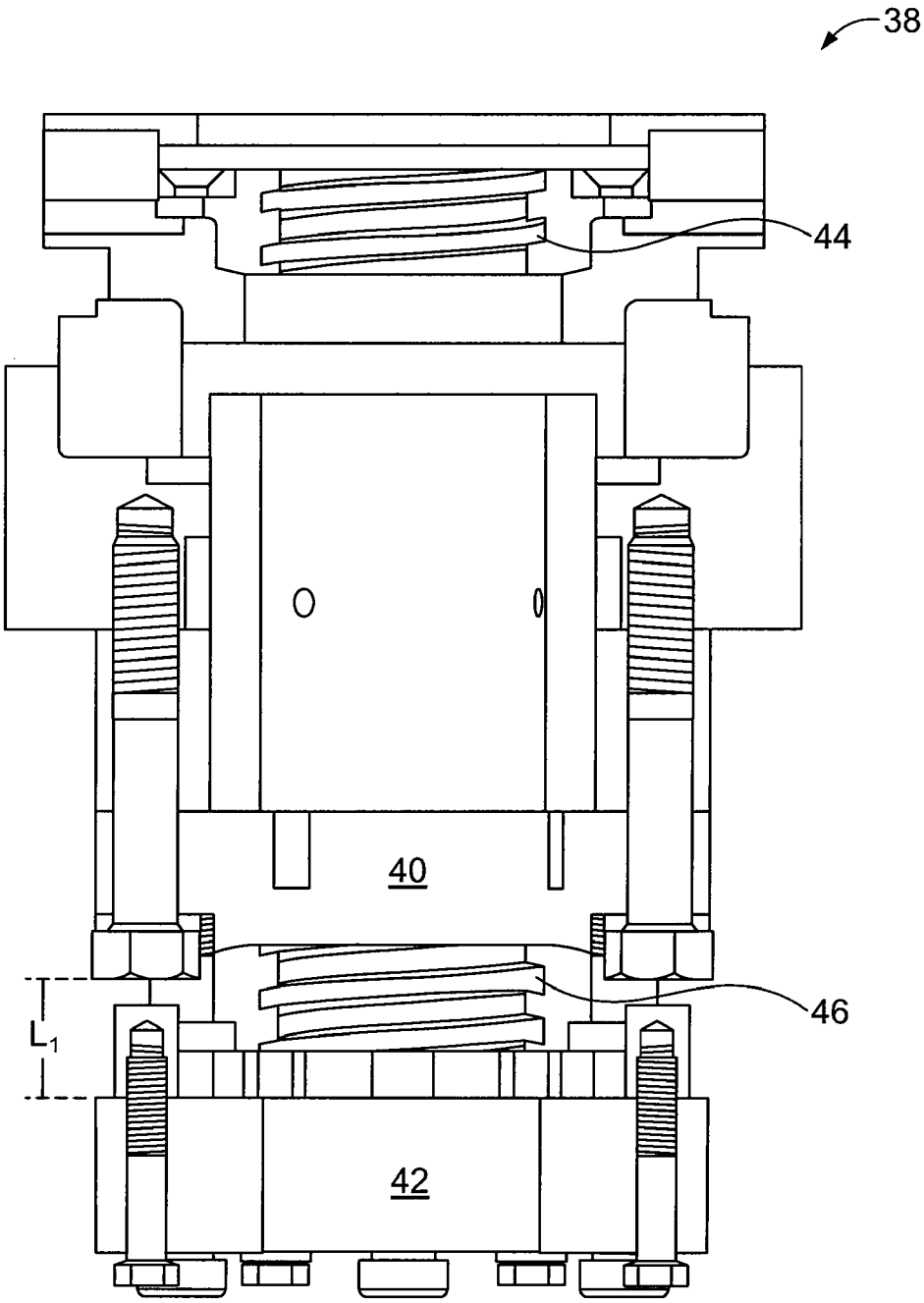
FIG. 5 is a sectional view of the nut assembly used in an embodiment of the claimed lift system.

As shown in FIGS. 3, 5 and 5A, a nut assembly 38 may be used to secure the cab-lifting beam 24 to the lift screw 20, 22. The nut assembly 38 may include a load-supporting nut 40, a safety nut 42 which is displaced a first distance $L_1$ from the load-supporting nut 40, a first grease seal 44 located on a first side of the load-supporting nut 40, and a second grease seal 46 located on a second side of the load-supporting nut 40 between the load-supporting nut 40 and the safety nut 42.

Any suitable form of power system 34, 36 may be used to rotate the lift screws 20, 22 including, but not limited to, a first and second motor which may be electrical, hydraulic, or pneumatic power systems. The electrical motors may also be controlled by variable frequency drives 50.

Figure 8:
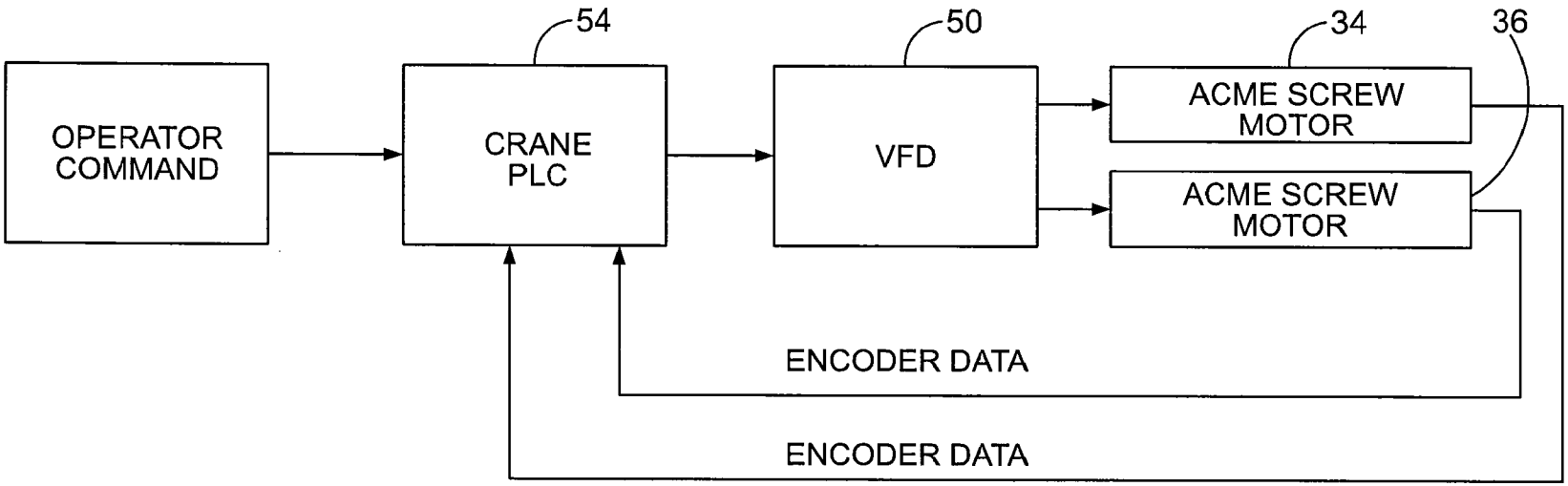
FIG. 8 is a block flow diagram of a control system used in an embodiment of the claimed lift system.

The first and second power systems may 34, 36 also be equipped with encoders, as shown in FIG. 8, these encoders are capable of, among other things, controlling the speed and position of the vertically-elevating cab 12. The encoders may also synchronizes a rotation of the lifting screws 20, 22 such that the cab 12 remains level through an entire range of cab motion.

When in operation, the two power systems 34, 36 supply power to their respective lift screws 20, 22, causing those screws 20, 22 to rotate. Depending on the direction of rotation, the vertically-elevating cab 12 is either raised or lowered as the screw threads engage the nut assembly 38, thereby causing the nut assembly 38 to advance along the length of the screw 20, 22. The pitch of the screw 20, 22 is such so that the screw 20, 22 is non-backdriving and the force of the load acting on the screw 20, 22 will not cause screw rotation, thereby providing maximum safety and reliability to the cab operator. Although a motor brake is not required to hold the load, one may be used to provide a redundant system for holding the vertically-elevating cab 12 at any desired position.

The load-supporting nut 40 of the nut assembly bears 38 the weight of the cab-lifting beam 24 and the vertically-elevating cab 12 as it travels along the length of the screw 20, 22. As shown in FIGS. 5 and 5A, the first 44 and second 46 grease seals retain grease on the Acme nut 40 to maintain lubrication on the nut 40 and screw 20, 22.

The load-supporting Acme nut 40 will wear with continued use and will eventually require replacement. The safety nut 42, which is displaced a first distance $L_1$ from the load-supporting nut 40 in the assembly 38, will support the load in the event of failure of the load-supporting nut 40. This displacement distance $L_1$ is used to indicate the amount of wear on the load-bearing nut 40 as measurement of the change in the first distance $L_1$ between the two nuts 40, 42 will indicate the amount of wear on the load-supporting nut 40.

As the lift screws 20, 22 rotate, the mounting arrangement of the cab 12 on the cab-lifting beam 24, as shown in FIGS. 1 and 4, causes a turning moment on the cab lifting-beam 24 because the center of gravity of the cab 12 is not in line with the center of gravity of the cab-lifting beam 24. The rollers 30 on both the first 26 and second 28 ends of the cab-lifting beam 24 provide a reaction to the turning moment on the cab-lifting beam 24, thereby stabilizing the beam throughout its movement.

In an embodiment, the electric motors 34, 36 that drive the lifting screws 20, 22 are controlled by variable frequency drives (VFD) 50, as shown in FIG. 8. These VFDs 50 provide speed control to the vertically-elevating cab 12. In another embodiment, as shown in FIG. 8, the drive motors 34, 36 are equipped with encoders. In such an embodiment, the software of the computer 54 onboard the vertically-elevating cab 12 uses the encoder data to control the speed and position of the cab 12 by means of the VFDs 50 that control the power systems 34, 36 associated with each respective lift screw 20, 22. This control system synchronizes the lift screws 20, 22, thereby assuring that the vertically-elevating cab 12 remains level throughout the entire range of motion of the cab 12. The system can also provide for reduce speed zones at the top or bottom of the cab's range of travel or anywhere within such range. A reduced speed performance option may also be used to allow for very fine positioning of the cab 12 in a particular spot.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A lifting system for a vertically-elevating cab, the lifting system comprised of:

a frame assembly having a first and a second support column;

a first and a second lift screw attached to the, respective, first and second support column;

a cab-lifting beam having a first and a second end attached to the, respective, first and second lift screw;

a plurality of rollers located on each end of the cab-lifting beam, each one of the plurality of rollers in contact with a guide bar on each of the respective first and second support columns;

the vertically-elevating cab mounted on the cab-lifting beam in such a manner that the center of gravity of the cab is not aligned with a center of the cab-lifting beam; and a first and a second power system connected to the, respective, first and second lift screw.

2. The lifting device of claim 1, wherein each of the first and second rotating lifting screws are Acme screws.

3. The lifting device of claim 1, wherein a screw pitch is such that the screw is non-backdriving.

4. The lifting system of claim 1 further comprised of a first and a second bearing support attached at a respective first and second end of the lift screw.

5. The lifting system of claim 1, wherein a nut assembly secures the cab-lifting beam to the lift screw.

6. The lifting system of claim 5, wherein the nut assembly includes:

a load-supporting nut;

a safety nut displaced from the load-supporting nut;

a first grease seal located on a first side of the load-supporting nut; and a second grease seal located on a second side of the load-supporting nut between the load-supporting nut and the safety nut.

7. The lifting system of claim 6, wherein the safety nut is displaced a first distance from the load supporting nut.

8. The lifting system of claim 1 further comprising a first and a second motor for the respective first and second power systems.

9. The lifting device of claim 8, wherein each of the first and second motors is an electric motor[s].

10. The lifting device of claim 9, wherein the electric motors are controlled by variable frequency drives.

11. The lifting device of claim 1, wherein each of the first and second power systems are hydraulic.

12. The lifting device of claim 1, wherein each of the first and second power sources are pneumatic.

13. The lifting system of claim 1, wherein each of the first and second power systems is equipped with encoders that are capable of controlling the speed and position of the vertically-elevating cab.

14. The lifting system of claim 13, wherein the encoders synchronizes a rotation of the lifting screws such that the cab remains level through an entire range of cab motion.

* * * * *